US012098499B2

(12) United States Patent
Burkhart et al.

(10) Patent No.: US 12,098,499 B2
(45) Date of Patent: Sep. 24, 2024

(54) LAUNDRY DETANGLING AND PAIRING CLIPS

(71) Applicant: ANDIAMO HOME, LLC, Peyton, CO (US)

(72) Inventors: Aurora Burkhart, Peyton, CO (US); Andrew Burkhart, Peyton, CO (US)

(73) Assignee: ANDIAMO HOME, LLC, Peyton, CO (US)

( * ) Notice: Subject to any disclaimer, the term of this patent is extended or adjusted under 35 U.S.C. 154(b) by 0 days.

(21) Appl. No.: 18/332,236

(22) Filed: Jun. 9, 2023

(65) Prior Publication Data

US 2023/0399793 A1 Dec. 14, 2023

Related U.S. Application Data

(60) Provisional application No. 63/366,306, filed on Jun. 13, 2022.

(51) Int. Cl.
*D06F 95/00* (2006.01)
*A44B 11/04* (2006.01)

(52) U.S. Cl.
CPC ..... *D06F 95/008* (2013.01); *A44B 11/04* (2013.01)

(58) Field of Classification Search
CPC ..... A44B 11/04; D06F 95/008; D06F 55/00
See application file for complete search history.

(56) References Cited

U.S. PATENT DOCUMENTS 561,475 A * 6/1896 Baringer ..... D06F 55/00 24/555
639,568 A * 12/1899 Herald ..... D06F 55/00 24/72.1
656,805 A * 8/1900 Bowman ..... D06F 55/00 211/89.01
777,751 A * 12/1904 Sayle ..... D06F 55/00 24/130
960,847 A * 6/1910 Devore ..... D06F 55/00 24/549
1,250,308 A * 12/1917 Hanson ..... D06F 55/00 D8/395
1,274,344 A * 7/1918 Staub ..... D06F 55/00 24/561

(Continued)

FOREIGN PATENT DOCUMENTS

CA 2542561 C * 11/2011 ..... A45F 5/004

*Primary Examiner* — Robert Sandy
*Assistant Examiner* — Louis A Mercado
(74) *Attorney, Agent, or Firm* — Chad G. Clark; Martensen IP

(57) ABSTRACT

A clip for managing laundry items, the clip having front and rear arms flexibly joined by an elbow and shaped to form an internal loop. The front arm terminates in a dogleg shaped to minimize catching on fabric, and the rear arm terminates in a tongue shaped to ease the clip onto fabric. The dogleg and tongue angle away from an opening to accommodate fabric and guide it into a gap between the arms. The elbow flexibly holds the arms apart to form the gap, which can expand to accept the fabric and hold it in place. The arms also include teeth to improve friction between the fabric and the clip. A method of using a system of laundry clips to improve laundry results, including folding a laundry item lengthwise and attaching a plurality of laundry clips on the item to hold loose sides in place.

18 Claims, 5 Drawing Sheets

(56) References Cited

U.S. PATENT DOCUMENTS

| | | | | | |
|---|---|---|---|---|---|
| 2,310,156 | A | * | 2/1943 | Van Der Clute | D06F 55/00 24/562 |
| D136,737 | S | * | 11/1943 | Woock | 24/571 |
| 2,429,557 | A | * | 10/1947 | MacCaferri | D06F 55/00 24/565 |
| 2,433,171 | A | * | 12/1947 | Tegarty | D06F 55/00 24/562 |
| 2,591,477 | A | * | 4/1952 | Tegarty | D06F 55/00 24/557 |
| D191,787 | S | * | 11/1961 | Heil | 24/562 |
| D199,310 | S | * | 10/1964 | Rizzuto | D28/39 |
| 3,600,764 | A | | 8/1971 | Froehlich | |
| 3,754,307 | A | | 8/1973 | Froehlich | |
| 4,170,299 | A | * | 10/1979 | Clements | B65D 71/00 24/562 |
| D309,361 | S | * | 7/1990 | Collyer | D32/62 |
| 5,234,139 | A | | 8/1993 | Korenstein | |
| 5,440,791 | A | | 8/1995 | Guio | |
| 5,499,431 | A | | 3/1996 | Mortensen et al. | |
| 5,546,641 | A | | 8/1996 | Radvin et al. | |
| 6,237,200 | B1 | | 5/2001 | Rodier et al. | |
| 6,457,218 | B1 | | 10/2002 | Lawrence | |
| 7,225,507 | B2 | | 6/2007 | Anderson et al. | |
| 10,590,591 | B2 | * | 3/2020 | Bruneau | F16B 2/22 |
| 11,078,621 | B2 | | 8/2021 | Bray | |
| 2003/0101551 | A1 | | 6/2003 | Levesque | |
| 2004/0093702 | A1 | | 5/2004 | Mallicoat | |
| 2008/0289159 | A1 | * | 11/2008 | Solich | D06F 55/00 24/571 |
| 2010/0088863 | A1 | | 4/2010 | Moy | |

* cited by examiner

LAUNDRY DETANGLING AND PAIRING CLIPS

CROSS-REFERENCE TO RELATED APPLICATIONS

This application claims priority to U.S. Provisional Application No. 63/366,306, filed Jun. 13, 2022, which is hereby incorporated herein in its entirety.

BACKGROUND OF THE INVENTION

Field of the Invention

Embodiments of the disclosed invention relate, in general, to devices, systems, and methods for improving the result of machine laundering and drying cycles by managing easily tangled or easily separated laundry items.

Relevant Background

Doing laundry is a household task requiring expensive infrastructure, significant resources, and substantial amounts of time. Efforts to reduce gas, electricity, and/or water use, and to reduce the time required to wash and dry clothes have resulted in more expensive machines and energy efficient laundering and drying cycles. Unfortunately, as machines have advanced it has become easier for larger laundry items to become bunched and tangled in the washer or dryer, often clumping together with smaller laundry items, and preventing items from being thoroughly cleaned or dried. Because tangling and bunching is not discovered until the end of the wash or dry cycle, time and resources are wasted. Further, paired items like socks are easily separated in the laundry and may be re-matched with difficulty, or lost altogether. Other items, such as women's swimsuits and bras include padding components that can become separated, bunched, or displaced.

Currently, there is no adequate single solution to manage laundry items, i.e., to prevent the tangling of large items or the separation of paired items in the laundry. Clips made of plastics or other polymers exist in the art. For example, U.S. Pat. No. 3,754,307 for a Garment Clip, discloses an inexpensive clip for holding a garment for display, such as a folded dress shirt; U.S. Pat. No. 3,600,764 for an Article-Hanging Clip, discloses an inexpensive clip for hanging clothing items; U.S. Pat. No. 6,457,218 B1 for a Plastic Clip, discloses a plastic clip with arms having a spring bias together; and U.S. Publication No. 2003/0101551 A1 for a Towel Fabric Clip. The foregoing clips are designed to be inexpensive, essentially disposable devices for securing dry clothing together.

Another group of devices, displaying varying degrees of complexity, are designed for holding socks or other paired items together in the laundry or for storage: U.S. Pat. No. 5,234,139, for an Apparatus for the Management of Paired Garments, discloses a plastic clamp for securing together a pair of socks; U.S. Pat. No. 5,440,791 for a Sock Clip discloses a plastic clip for holding a pair of socks together; U.S. Pat. No. 5,499,431 for a Spring Clip for Holding Garments, discloses a lockable spring clamp for securing together a pair of socks; U.S. Pat. No. 6,237,200 B1, for a Device for Clipping a Textile Article; U.S. Pat. No. 7,225,507 B2 for Sock Snaps. None of the foregoing clips are suitable for both preventing tangling of large items and securing together paired clothing items though laundry cycles. One existing solution, the Wad-Free™ laundry device, is presented as a device that can both prevent tangling and secure paired items together, however, the Wad-Free device is complicated, includes multiple materials and moving parts, and is not suitable for use in high heat or with harsh laundry chemicals.

Therefore, there is a need for a simple, inexpensive, easy to use, and effective laundry detangling and pairing device that is resilient and capable of use in high heat laundry cycles in the presence of harsh chemicals.

BRIEF DESCRIPTION OF THE DRA WINGS

Features and objects of the disclosed invention and the manner of attaining them will become more apparent, and the invention itself will be best understood, by reference to the following description of one or more embodiments taken in conjunction with the accompanying drawings and figures imbedded in the text below and attached following this description.

The Figures attached depict embodiments of the disclosed invention for purposes of illustration only. One skilled in the art will readily recognize from the following discussion that alternative embodiments of the structures and methods illustrated herein may be employed without departing from the principles of the invention described herein.

Figure 4A:
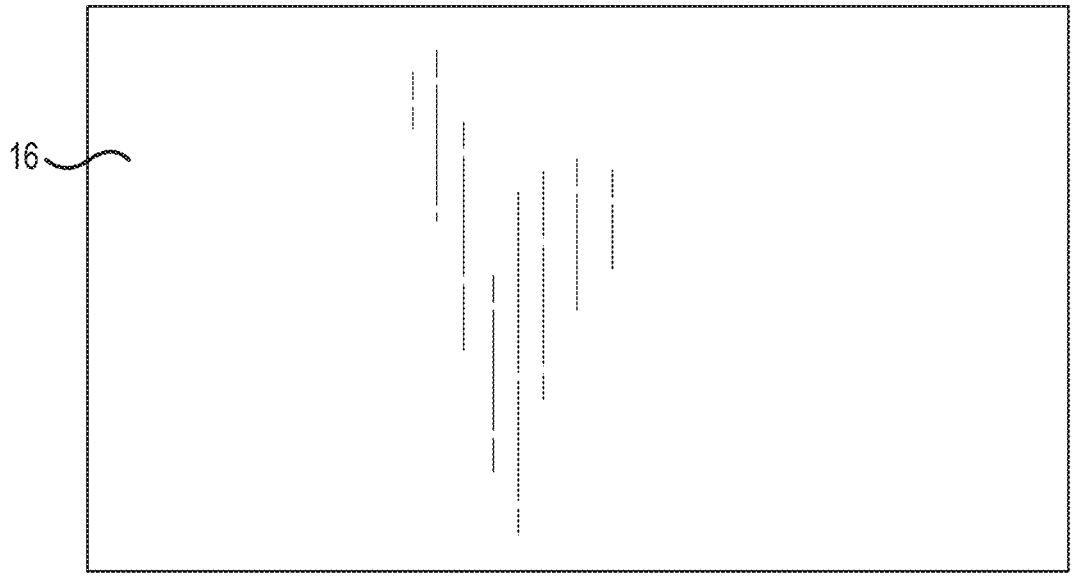
Figure 4B:
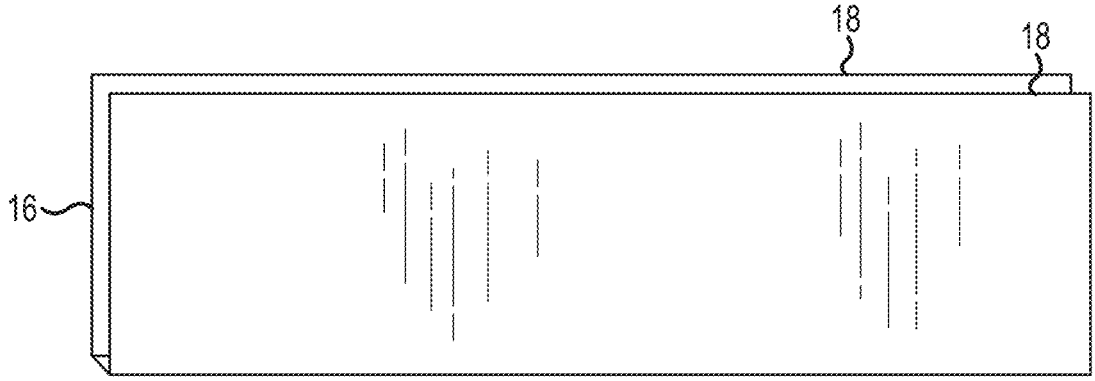
Figure 4C:
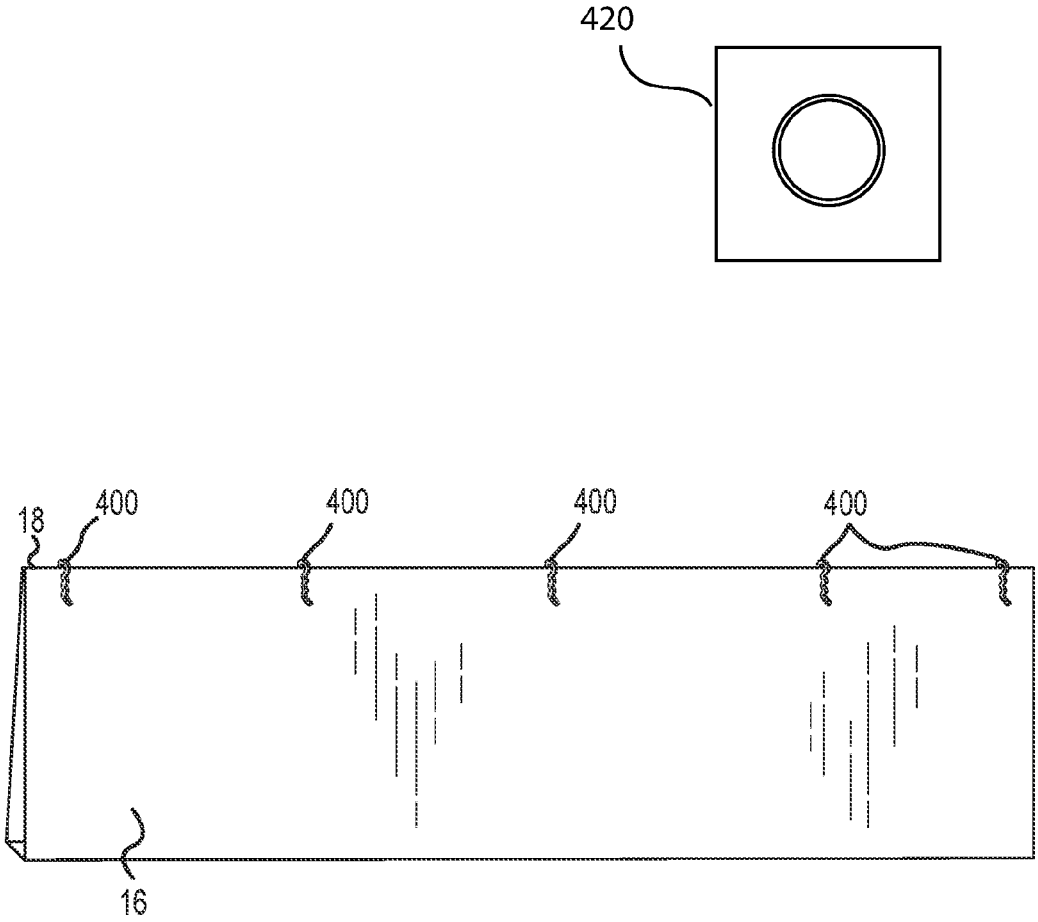

FIGS. 4A, 4B, and 4C depict a method of using the disclosed invention to prevent a laundry item from tangling in a laundry cycle.

DETAILED DESCRIPTION OF THE INVENTION

The detailed description of the disclosed invention will be primarily, but not entirely, limited to devices, systems, and methods improving the results of machine laundering and drying cycles by use of a plurality of clips configured to prevent the tangling of larger laundry items, or the use of one or more clips to keep paired items together.

The disclosed invention will now be described in detail with reference to several embodiments thereof as illustrated in the accompanying Figures. In the following description, numerous specific details are set forth in order to provide a thorough understanding of embodiments of the disclosed application. It will be apparent, however, to one skilled in the art that embodiments may be practiced without some or all of these specific details. In other instances, well known process steps and/or structures have not been described in detail in order to not unnecessarily obscure the present invention. The features and advantages of embodiments may be better understood with reference to the drawings and discussions that follow.

It should be apparent to those skilled in the art that the described embodiments of the disclosed invention provided herein are illustrative only and not limiting, having been presented by way of example only. All features disclosed in this description may be replaced by alternative features serving the same or similar purpose, unless expressly stated otherwise. Therefore, numerous other embodiments of the modifications thereof are contemplated as falling within the scope of the present invention as defined herein and equivalents thereto. Hence, use of absolute and/or sequential terms, such as, for example, "always," "will," "will not," "shall," "shall not," "must," "must not," "first," "initially," "next," "subsequently," "before," "after," "lastly," and "finally," are not meant to limit the scope of the present invention as the embodiments disclosed herein are merely exemplary.

It will be also understood that when an element is referred to as being "on," "attached" to, "connected" to, "coupled" with, "contacting", "mounted" etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under," "below," "lower," "over," "upper," and the like, may be used herein for ease of description to describe one element or feature's relationship to another element(s) or feature(s) as illustrated in the figures. It will be understood that the spatially relative terms are intended to encompass different orientations of a device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of "over" and "under". The device may be otherwise oriented (rotated 90 degrees or at other orientations) and the spatially relative descriptors used herein interpreted accordingly. Similarly, the terms "upwardly," "downwardly," "vertical," "horizontal" and the like are used herein for the purpose of explanation only unless specifically indicated otherwise.

Figure 1:
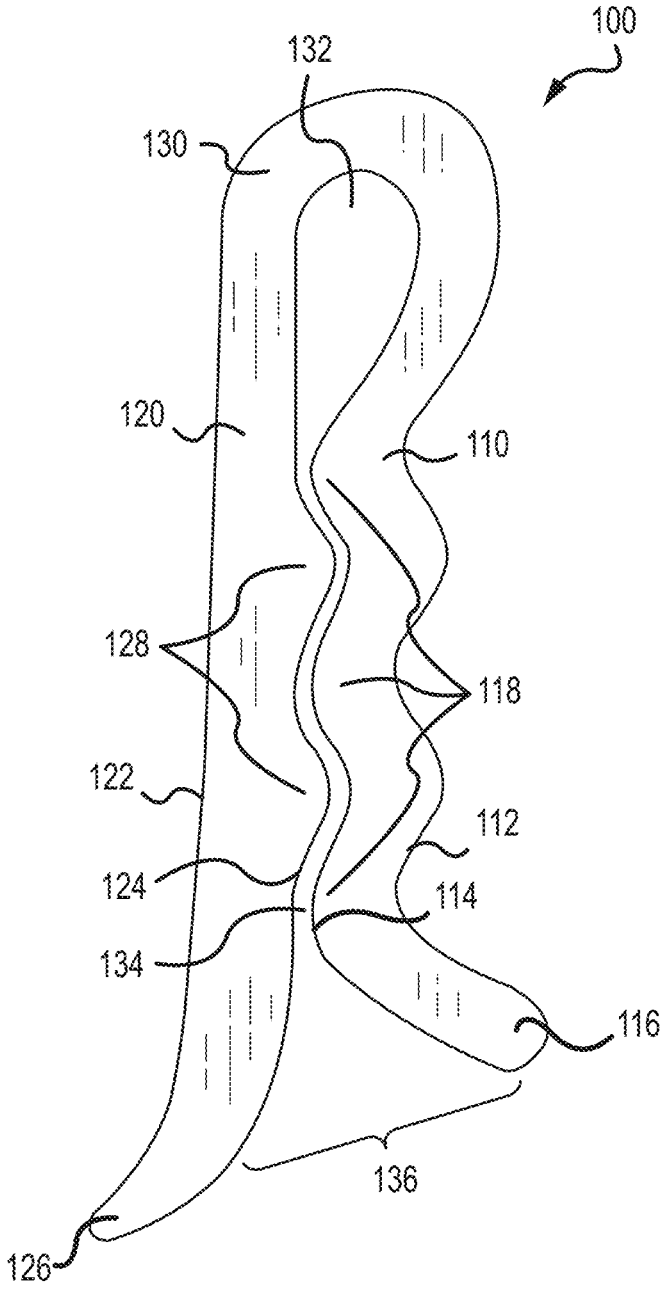
FIG. 1 depicts a profile view of an embodiment of the disclosed invention.
Figure 2:
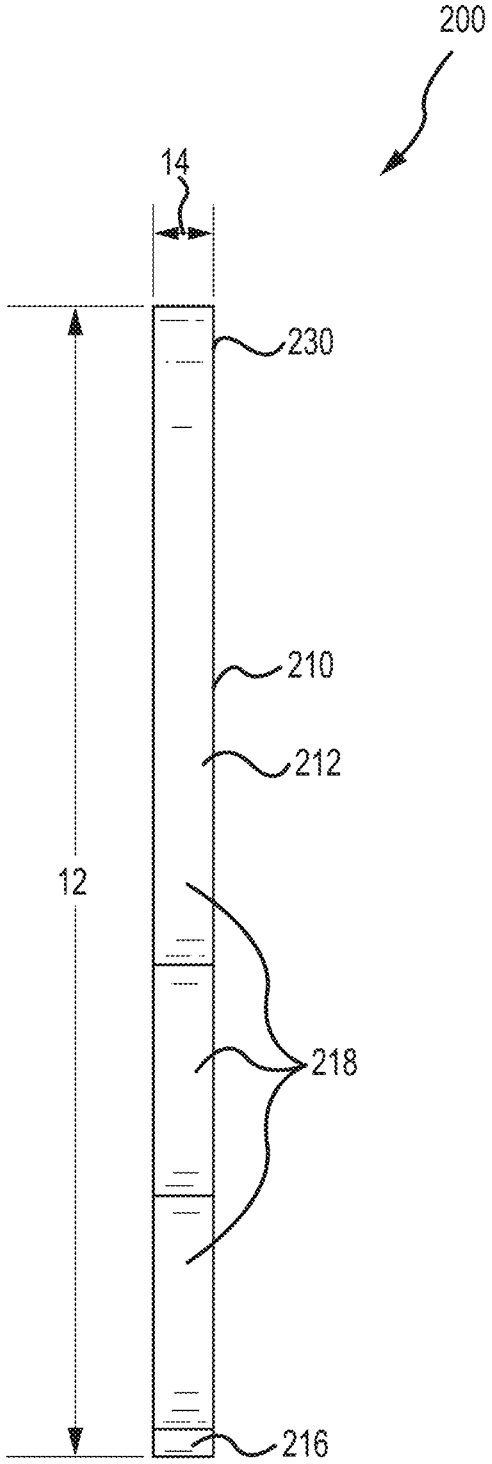
FIG. 2 depicts an edge-on view of an embodiment of the disclosed invention.

With reference to FIG. 1, a laundry clip 100 of the disclosed invention is depicted. The laundry clip is comprised of a single piece of material having a U shape and including a front arm 110 and a rear arm 120 joined by a rounded end or elbow 130. The arms and elbow are all the same thickness, e.g., 2 millimeters (mm), 3 mm, 3.5 mm, 4 mm, 4.5 mm, or 5 mm. Preferably, as shown in FIG. 2, Item 14, the thickness is about 4 mm. The elbow 130 is configured to hold the front arm and rear arm apart to create a gap 134, which may be 0.5 mm, 1.0 mm, 1.5 mm, 2.0 mm, or 2.5 mm. Preferably, the gap is 1.0 mm, which is the minimum sized gap available for standard injection molding processes. The elbow 130 forms an interior loop 132 for accommodating a quantity of fabric when the clip is placed on a laundry item. The loop 132 is sized to hold the fabric gathered within it loosely enough to be wetted during the wash cycle and dried during the dryer cycle. As depicted, the loop 132 has a semi-rounded shape, with a flat side delineated by the interior side 124 of the rear arm. The elbow 130 also functions as a spring, and tends to maintain the arms at the gap separation distance, while flexing to allow the arms to be pulled apart. When pulled apart, the elbow causes the arms to exert a tensile force on clothing placed between the arms.

The front arm 110 and rear arm 120 each have an exterior side 112, 122 and an interior side 114, 124. The interior and exterior sides, as well as the interior loop 132 and outside of the elbow 130, all form generally flattened surfaces that can be modified by including texturing or teeth as discussed below. The flat interior surfaces of the arms provide surface area and thus friction to hold laundry items in place. The front arm 110 includes a dogleg 116. The dogleg 116 is angled outward and away from the rear arm, and is blunt and rounded to minimize the clip catching on material as the clip is placed on a laundry item. The rear arm 120 includes a straight exterior side 122, and has a tongue 126 that extends past the dogleg and curves outward and away from the front arm 110. The tongue 126 ends in a thin, rounded point that aids in fitting the clip over laundry items. The tongue 126 and dogleg 116 together create an opening 136 configured to accommodate laundry items and funnel the items into the gap 134.

The front arm 110 and rear arm 120 are also shaped to include a plurality of teeth 118, 128 that hold laundry items in place within the clip. The teeth interlock without touching, as the gap extends from the loop 132 to the opening 136. In the depicted embodiment, the front arm 110 is shaped to have three teeth 118. As depicted, the interior side 114 and exterior side 112 of the front arm mirror each other so that the front arm has a curved appearance. These teeth 118 are located to correspond to two teeth 128 on the interior side 124 of the rear arm 120. In some embodiments, the front arm resembles the rear arm by having a straight exterior side 112 with teeth only appearing on the interior side 114. Some embodiments may have fewer or more teeth, for example two teeth on the front arm and one on the rear arm, or four teeth on the front arm and three on the rear arm. The lengths of the front arm and rear arm may also be adjusted to accommodate fewer or more teeth. The number of teeth can be adjusted in different embodiments to provide an adequate amount of friction to hold the laundry items.

The disclosed laundry clips have a holding power, meaning the combination of tensile force applied by the elbow 130 and arms 110, 120, and the frictional force provided by the teeth 118, 128 and interior sides 114, 124. The holding power supplied by an embodiment may vary based on the material used for the laundry clip, the size of the elbow and arms, the number of teeth, or other relevant property of the clip. For example, the material comprising the laundry clip may be more or less elastic to provide different amounts of tensile force, or the material surface may be tacky or rough, or nonadhesive or smooth to supply more or less friction. To increase friction, interior surfaces 114, 124 also may be textured, such as by including patterns of ridges, grooves, bumps, or other suitable features. Similarly, higher tensile force may be provided by increasing the thickness of the elbow and arms, or by using a stiffer material. Likewise, an embodiment with more teeth would supply more friction than a similar clip with fewer teeth.

In order to achieve a required holding power, different embodiments may be configured to distribute the holding power differently between tensile force and friction depending on the application. For example, delicate laundry items may require lower tensile force, and thus more friction to hold the items in place. By contrast, a pair of wool socks may require lower friction and higher tensile force to remain in place through a laundry cycle. Multiple configurations are possible and contemplated.

With reference to FIG. 2, an edge-on view of the disclosed laundry clip 200 is shown. This view shows approximate dimensions of an embodiment of the disclosed laundry clip, having a length 12 of approximately 76 mm (3 inches) and a thickness 14 of about 4 mm. Also visible are the elbow 230, as well as the front arm 210 and some of its components.

Figure 3:
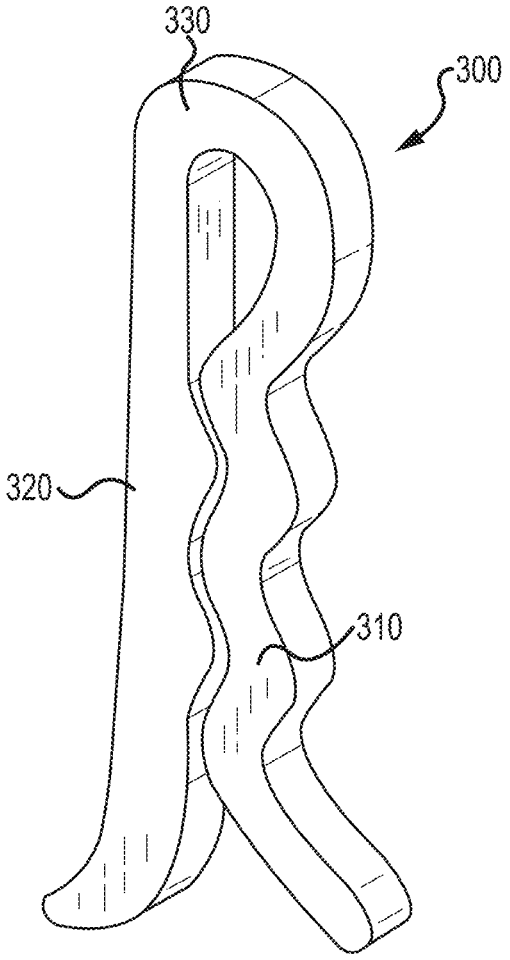
FIG. 3 depicts a perspective view of an embodiment of the disclosed invention.

With reference to FIG. 3, a perspective view of the disclosed laundry clip 300 is shown. The laundry clip is shown with a front arm 310, rear arm 320, and elbow 330, and various other components (not labeled).

The disclosed laundry clips are designed to meet several criteria in order for the clips to perform adequately for an extended number of washing and drying cycles. The use environments within the typical washing machine, see FIG. 4C, item 420, and dryer 420 are challenging. Wash cycles typically last from 20 to 40 minutes, and typical dryer cycles last from 30 to 90 minutes. Water in washing machines 420 can vary from 60 degrees Fahrenheit (° F.) for cold cycles to 130° F. for hot cycles. Dryer 420 heat settings vary from 120° F. to 175° F. Not only are laundry clips repeatedly subject to temperature extremes, but are soaked in water and exposed to chemicals such as bleach, detergents, surfactants, enzymes, starches, oxidizers, fabric softeners, neutralizers and others. Further, laundry clips are subject to spins and agitation over extended periods each cycle.

Because of these demands, laundry clips of the disclosed invention include design elements and material selection that together resist leaching chemicals into the laundry, resist absorbing water, resist deforming or degrading under sustained high temperatures, resist absorption of laundry chemicals, and can maintain shape and strength after multiple uses. Design elements that aid these characteristics include clip size, surface integrity (i.e., absence of sharp creases, points, or angles), and arm and elbow thickness and uniformity. These design elements promote strength, resilience, and decrease surface area for chemical absorption. Material composition also aids these characteristics. Material properties include chemical and water absorption resistance, strength, structural integrity, flexibility, and oxidation resistance. Clips may be made from aluminum, titanium, polyetheretherketone, polyamideimide polyetherimide, polyphenylene sulfide, and polyphenylsulfone. Other suitable plastics, polymers, or nylons may also be used. In preferred embodiments, the disclosed laundry clips are manufactured by injection molding processes. In some embodiments, the laundry clips are made from a single piece of material.

In use, the disclosed laundry clips can perform various functions. To keep paired items, e.g. socks, together, a single laundry clip is placed over both items before placing them in the washer or dryer. The disclosed clips may also be used to improve laundering results for women's swimsuits and bras. For example, one or more clips can be placed on bra padding panels to secure the padding in place during washer and/or dryer cycles. As another example, a clip may be placed over a bra clasp to secure it in place and prevent the clasp from snagging on and damaging other laundry items.

With reference to FIG. 4A, to prevent larger items 16, e.g., an elasticized or fitted sheet, from becoming tangled during a laundry cycle, the following steps may be followed. With reference to FIG. 4B, a clip user first folds the sheet in half lengthwise with the sheet edges 18 facing up (elastic side up for fitted sheets). With reference to FIG. 4C, the user next places one laundry clip 400 in the center of the sheet 16 and one laundry clip 400 at each end to clip the edges 18 of the sheet together. Then the user places additional laundry clips 400 equidistant from the center clip and the ends of the sheet. Larger items, such as California king sheets require around five laundry clips, while smaller items, such as infant bed sheets, may only require two or three laundry clips. The disclosed clips can be used with many laundry items, such as towels, tablecloths, sheets, fitted sheets, curtains, drapes, shower curtains, blankets, duvet covers, furniture covers, rugs, etc. The laundry items can then be placed in the washer or dryer.

Although the invention has been described and illustrated with a certain degree of particularity, it is understood that the present disclosure has been made only by way of example and that numerous changes in the combination and arrangement of parts can be resorted to by those skilled in the art without departing from the spirit and scope of the invention.

The attached description with reference to the accompanying drawings is provided to assist in a comprehensive understanding of exemplary embodiments of the present invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

The terminology used herein is for the purpose of describing particular embodiments only and is not intended to be limiting of the invention. As used herein, the singular forms "a," "an," and "the" are intended to include the plural forms as well, unless the context clearly indicates otherwise. Thus, for example, reference to "a component surface" includes reference to one or more of such surfaces.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

As used herein, the terms "comprises," "comprising," "includes," "including," "has," "having" or any other variation thereof, are intended to cover a nonexclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As will be understood by those familiar with the art, the disclosed invention may be embodied in other specific forms without departing from the spirit or essential characteristics thereof. Likewise, the particular naming and division of the modules, managers, functions, systems, layers, features, attributes, methodologies, and other aspects are not mandatory or significant, and the mechanisms that implement the invention or its features may have different names, divisions, and/or formats. Accordingly, the disclosure of the present invention is intended to be illustrative, but not limiting, of the scope of the invention.

This has been a description of the disclosed invention along with a preferred method of practicing the invention.

What is claimed is:

1. A clip for managing laundry items, comprising:

a front arm and a rear arm flexibly connected by an elbow and forming an internal loop;

the front arm having a dogleg opposite the elbow, and the rear arm having a tongue opposite the elbow, wherein the dogleg and the tongue form an opening;

the front arm and the rear arm separated by a gap extending from the loop to the opening;

the front arm and the rear arm further including a plurality of interlocking teeth, and wherein the clip is configured for use in water temperatures ranging from 60 degrees Fahrenheit (° F.) to 130° F. and in air temperatures ranging from 120° F. to 175° F.

2. The clip for managing laundry items of claim 1, the rear arm further comprising an outer side, the outer side forming a straight edge from the elbow to the tongue.

3. The clip for managing laundry items of claim 1, the dogleg angled outwardly from the rear arm, and the tongue curved outwardly from the front arm.

4. The clip for managing laundry items of claim 1, the dogleg having a rounded end, and the tongue having a rounded point.

5. The clip for managing laundry items of claim 1, wherein the front arm includes three teeth and the rear arm includes two teeth.

6. The clip for managing laundry items of claim 1, wherein the gap is one of 0.5 millimeters (mm), 1.0 mm, 1.5 mm, 2.0 mm, or 2.5 mm.

7. The clip for managing laundry items of claim 1, wherein the clip is made of one of a polyetheretherketone, a polyamideimide polyetherimide, a polyphenylene sulfide, a polyphenylsulfone, or a nylon.

8. The clip for managing laundry items of claim 1, wherein the clip has a holding power, the holding power comprising a tensile force and a frictional force.

9. A method of using a system of laundry clips using the clip of claim 1, the method comprising:

folding a laundry item, the laundry item having a generally rectangular shape with a pair of short sides and a pair of long sides, wherein the pair of long sides are brought together;

attaching a first laundry clip at or near a center point of the pair of long sides to hold the pair of long sides together;

attaching a second laundry clip at or near a first end of the pair of long sides;

attaching a third laundry clip at or near a second end of the pair of long sides;

attaching one or more additional laundry clips to the pair of long sides to secure the pair of long sides together; and placing the laundry item in a laundry machine.

10. The method of using a system of laundry clips of claim 9, wherein the laundry item is one of: a sheet, a fitted sheet, a towel, a tablecloth, a curtain, a blanket, or a rug.

11. The method of using a system of laundry clips of claim 9, wherein the laundry machine is one of a clothes washer, or a clothes dryer.

12. A laundry clip, comprising:

a front arm, a rear arm, and an elbow forming a U shape, the front arm joining the rear arm at the elbow and forming an internal loop within the elbow;

the front arm having a dogleg opposite the elbow, and the rear arm having a tongue opposite the elbow;

the front arm having a front internal side and a front external side, and the rear arm having a rear internal side and a rear external side;

the front internal side and the rear internal side separated by a gap that extends from the internal loop to an opening opposite the elbow;

the front internal side and the rear internal side further including a plurality of alternating teeth; and wherein the clip is configured for use in water temperatures ranging from 60° F. to 130° F. and in air temperatures ranging from 120° F. to 175° F.

13. The laundry clip of claim 12, wherein the rear external side is straight from the elbow to the tongue.

14. The laundry clip of claim 12, wherein the tongue curves away from the front arm and ends in a rounded point, and the dogleg is angled away from the rear arm and has a rounded end.

15. The laundry clip of claim 12, wherein the front arm includes three teeth, and the rear arm includes two teeth.

16. The laundry clip of claim 12, wherein the gap is one of 0.5 millimeters (mm), 1.0 mm, 1.5 mm, 2.0 mm, or 2.5 mm.

17. The laundry clip of claim 12, wherein the clip is made of one of a polyetheretherketone, a polyamideimide polyetherimide, a polyphenylene sulfide, a polyphenylsulfone, or a nylon.

18. The laundry clip of claim 12, wherein the clip has a holding power, the holding power comprising a tensile force and a frictional force.

* * * * *